United States Patent [19]

Gretzinger et al.

[11] Patent Number: 4,469,739

[45] Date of Patent: Sep. 4, 1984

[54] ORIENTED WOVEN FURNITURE SUPPORT MATERIAL

[75] Inventors: James Gretzinger, Washington; Robert L. Rackley, Parkersburg, both of W. Va.

[73] Assignee: E. I. Du Pont de Nemours and Company, Wilmington, Del.

[21] Appl. No.: 516,517

[22] Filed: Jul. 26, 1983

Related U.S. Application Data

[63] Continuation-in-part of Ser. No. 460,099, Jan. 21, 1983, abandoned, which is a continuation-in-part of Ser. No. 407,647, Aug. 12, 1982, abandoned.

[51] Int. Cl.[3] ..... A47C 7/32; A47C 23/18; A47C 23/22; A47C 31/00

[52] U.S. Cl. ..... 428/198; 5/230; 139/420 A; 139/421; 297/452; 297/463; 428/229; 428/231; 428/255; 428/257; 428/288; 428/296

[58] Field of Search ..... 428/198, 229, 231, 255, 428/257, 296, 288; 5/230; 297/452, 463; 139/420 A, 421

[56] References Cited

U.S. PATENT DOCUMENTS

| | | | |
|---|---|---|---|
| 2,940,512 | 6/1960 | Reed . | |
| 3,023,192 | 2/1962 | Shivers, Jr. . | |
| 3,084,980 | 4/1963 | Lawson | 297/455 |
| 3,132,354 | 5/1964 | Doerer . | |
| 3,473,576 | 10/1969 | Amneus | 139/420 |
| 3,651,014 | 3/1972 | Witsiepe . | |
| 3,763,109 | 10/1973 | Witsiepe . | |
| 3,766,146 | 10/1973 | Witsiepe . | |
| 3,915,202 | 10/1975 | Curtis et al. | 139/425 |
| 3,992,499 | 11/1976 | Lee | 264/78 |
| 4,136,715 | 1/1979 | McCormack et al. | 138/130 |
| 4,161,500 | 6/1979 | Schleinitz et al. | 264/1 |

FOREIGN PATENT DOCUMENTS

| | | |
|---|---|---|
| 621569 | 6/1961 | Canada . |
| 1458341 | 12/1976 | United Kingdom . |

OTHER PUBLICATIONS

Copending U.S. Patent Appln. Ser. No. 284,236 filed Jul. 17, 1981, by Hansen et al.

"Challenge of Change", a publn. of E. I. du Pont de Nemours & Co., Jan. 1977.

"Elastomeric Oriented Copolyesters," publn. of E. I. du Pont de Nemours & Co. relating to ELOC Materials.

"Man Made Fibers", R. W. Moncrieff, Chapter 24, pp. 434–481 (1975).

*Primary Examiner*—James C. Cannon

[57] ABSTRACT

Oriented woven furniture support materials made in part from elastomer monofilament and in part from yarn have been found to possess a unique combination of properties including high strength, low creep and good flexibility. These furniture support materials can be made by weaving of the elastomer in a first direction and the yarn in a second direction perpendicular to the first direction followed by heat-setting of the woven material.

26 Claims, No Drawings

ORIENTED WOVEN FURNITURE SUPPORT MATERIAL

CROSS REFERENCE TO RELATED APPLICATION

This is a continuation-in-part of Application Ser. No. 460,099 filed Jan. 21, 1983, now abandoned, which is, in turn, a continuation-in-part of Application Ser. No. 407,647, filed Aug. 12, 1982, now abandoned.

DESCRIPTION

Technical Field

This invention relates to certain synthetic oriented woven materials suitable for use in furniture, for example in seats, beds, sofas and chairs. The furniture support material of the present invention will be particularly useful in automobile seats (both bottoms and backs) and in seats used in other forms of ground transportation (e.g. buses, trains, etc) and in aircraft, where a combination of comfort, strength, and especially light weight is important. Typically, the furniture support material of the present invention is suitable for use as a flexible support member in seat bottoms and backs where traditionally, such support members have taken the form of springs, webs, straps or molded units (e.g. thick foam pads), and materials of construction for such seat support members have been steel, burlap, canvas, plastic and elastomer strapping and synthetic textile materials. Similarly, the furniture support material is suitable for use in beds in lieu of box or wire springs, especially in fold-away and portable beds where compact size and light weight are especially important. Such furniture support materials must satisfy certain physical requirements including high strength, low creep (shape and size retention), high durability, ability to flex under load, and increasingly in today's marketplace, low weight. Increasing demand for improvements in one or more of these criteria lay the groundwork for the present invention.

Background Art

U.S. Pat. Nos. 3,651,014; 3,763,109; and 3,766,146, granted Mar. 21, 1972, Oct. 2 and Oct. 16, 1973, respectively, all to Witsiepe disclose certain copolyetherester elastomers which can be used alone or in combination with each other as one of the materials of construction in the woven furniture support material of the present invention.

British Pat. No. 1,458,341, published Dec. 15, 1976 to Brown et al, discloses an orientation and heat-setting process for treating copolyetherester elastomers, which process is conveniently and beneficially used to treat the elastomers disclosed by Witsiepe in U.S. Pat. Nos. 3,763,109 and 3,766,146. The Brown process can be used to treat filaments of Witsiepe's copolyetherester elastomers which can be subsequently used in the woven furniture support material of the present invention.

U.S. Pat. No. 4,136,715, granted Jan. 30, 1979 to McCormack et al, discloses composites of different copolyetherester elastomers having melting points differing from each other by at least 20° C. Such composites can be used in the woven furniture support material of the present invention and are conveniently formed as a "sheath/core" monofilament (as shown in FIG. 1 of McCormack et al) where the core copolyetherester elastomer is the higher melting point material.

Copending U.S. Patent Application Ser. No. 284,326, filed July 17, 1981 by Hansen et al., discloses a paper-making belt of machine and transverse direction thermoplastic filaments, the filaments in at least one of the machine and transverse directions being co-extruded sheath/core monofilaments which can be (among other things) copolyetherester elastomers, such as disclosed by Witsiepe. While Hansen's paper-making belts can be of a similar material of construction to the furniture support material of the present invention, they would lack sufficient flexibility for use as a furniture support material; and, in any event, Hansen prefers materials other than the Witsiepe copolyetherester elastomers used in the present invention.

DISCLOSURE OF THE INVENTION

This invention relates to synthetic oriented net furniture support material made in part from certain orientable thermoplastic elastomers and in part from certain non-elastomeric natural or synthetic yarns. The net structure used in the furniture support material of the present invention can be prepared by extruding a plurality of thermoplastic elastomer monofilaments, orienting the thermoplastic elastomer monofilaments, preparing non-elastomeric yarn, placing the monofilaments and yarn into a net-like configuration, e.g. by weaving the thermoplastic elastomer monofilaments in one direction and the yarn in the perpendicular direction, and then bonding or otherwise affixing the monofilaments and yarn to each other where ever they intersect. Preferably the thermoplastic elastomer monofilaments will be in the fill (or woof) direction and the yarn will be woven in the warp direction. Standard weaving techniques, e.g. as shown in Fiber to Fabric, M. D. Potter, pages 59–73 (1945), can be used to prepare the furniture support material of the present invention.

The orientable thermoplastic elastomer used in the furniture support material of the present invention can be a copolyetherester elastomer, a polyurethane elastomer, or a polyesteramide elastomer. It can be a solid monofilament, where the material of construction is the same throughout the monofilament, or a sheath/core monofilament, where the melting point of the sheath component is substantially lower than the melting point of the core component. In any case, the $M_{20}$ strength (i.e. the tensile strength at 20% elongation, measured according to ASTM D-412) of the oriented thermoplastic elastomer monofilament should be 5,000–45,000 p.s.i. (34.5-310.3 MPa), preferably 15,000–25,000 (103.4-172.4 MPa).

The preferred thermoplastic elastomer for use in furniture support material of the present invention is a copolyetherester elastomer, such as disclosed by Witsiepe (U.S. Pat. Nos. 3,651,014; 3,763,109; and 3,766,146) and McCormack (U.S. Pat. No. 4,136,715), which material has been oriented for improved physical properties, such as by the technique disclosed by Brown et al (British Pat. No. 1,458,341).

The copolyetherester polymers which can be used in the instant invention consist essentially of a multiplicity of recurring intralinear long-chain and short-chain ester units connected head-to-tail through ester linkages, said long-chain ester units being represented by the following structure:

$$-OGO-\overset{O}{\overset{\|}{C}}R\overset{O}{\overset{\|}{C}}- \quad (a)$$

and said short-chain ester units being represented by the following structure:

$$-ODO-\overset{O}{\overset{\|}{C}}R\overset{O}{\overset{\|}{C}}- \quad (b)$$

wherein:

G is a divalent radical remaining after removal of terminal hydroxyl groups from poly(alkylene oxide) glycols having a carbon-to-oxygen ratio of about 2.0-4.3 and molecular weight between about 400 and 6000, preferably 600-2000;

R is a divalent radical remaining after removal of carboxyl groups from a dicarboxylic acid having a molecular weight less than about 300; and D is a divalent radical remaining after removal of hydroxyl groups from a low molecular weight diol having a molecular weight less than about 250.

The term "long-chain ester units" as applied to units in a polymer chain refers to the reaction product of a long-chain glycol with a dicarboxylic acid. Such "long-chain ester units," which are a repeating unit in the copolyetheresters of this invention, correspond to formula (a) above. The long-chain glycols are polymeric glycols having terminal (or as nearly terminal as possible) hydroxy groups and a molecular weight from about 400-6000. The long-chain glycols used to prepare the copolyetheresters of this invention are poly(alkylene oxide) glycols having a carbon-to-oxygen ratio of about 2.0-4.3.

Representative long-chain glycols are poly(ethylene oxide) glycol, poly(1,2- and 1,3-propylene oxide) glycol, poly(tetramethylene oxide) glycol, random or block copolymers of ethylene oxide and 1,2-propylene oxide, and random or block copolymers of tetrahydrofuran with minor amounts of a second monomer such as 3-methyltetrahydrofuran (used in proportions such that the carbon-to-oxygen mole ratio in the glycol does not exceed about 4.3). Poly(tetramethylene oxide) glycol in preferred; however, it should be noted that some or all of the long chain ester units derived from PTMEG (or any of the other listed long-chain glycols) and terephthalic acid can be replaced by similar long-chain units derived from a dimer acid (made from an unsaturated fatty acid) and butane diol. A $C_{36}$ dimer acid is commercially available.

The term "short-chain ester units" as applied to units in a polymer chain refers to low molecular weight compounds or polymer chain units having molecular weights less than about 550. They are made by reacting a low molecular weight diol (below about 250) with a dicarboxylic acid to form ester units represented by formula (b) above.

Included among the low molecular weight diols which react to form short-chain ester units are aliphatic, cycloaliphatic, and aromatic dihydroxy compounds. Preferred are diols with 2-15 carbon atoms such as ethylene, propylene, tetramethylene, pentamethylene, 2,2-dimethyltrimethylene, hexamethylene, and decamethylene glycols, dihydroxy cyclohexane, cyclohexane dimethanol, resorcinol, hydroquinone, 1,5-dihydroxy naphthalene, etc. Especially preferred are aliphatic diols containing 2-8 carbon atoms. While unsaturated low molecular weight diols are normally not preferred because they may undergo homopolymerization, it is possible to use minor amounts of diols such as 1,4-butene-2-diol in admixture with saturated diols. Included among the bis-phenols which can be used are bis(p-hydroxy)diphenyl, bis(p-hydroxyphenyl) methane, and bis(p-hydroxyphenyl) propane. Equivalent ester-forming derivatives of diols are also useful (e.g., ethylene oxide or ethylene carbonate can be used in place of ethylene glycol). The term "low molecular weight diols" as used herein should be construed to include such equivalent ester-forming derivatives; provided, however that the molecular weight requirement pertains to the diol only and not to its derivatives.

Dicarboxylic acids which are reacted with the foregoing long-chain glycols and low molecular weight diols to produce the copolyesters used in this invention are aliphatic, cycloaliphatic, or aromatic dicarboxylic acids of a low molecular weight, i.e., having a molecular weight of less than about 300. The term "dicarboxylic acids" as used herein, includes equivalents of dicarboxylic acids having two functional carboxyl groups which perform substantially like dicarboxylic acids in reaction with glycols and diols in forming copolyester polymers. These equivalents include esters and ester-forming derivatives, such as acid halides and anhydrides. The molecular weight requirement pertains to the acid and not to its equivalent ester or ester-forming derivative. Thus, an ester of a dicarboxylic acid having a molecular weight greater than 300 or an acid equivalent of a dicarboxylic acid having a molecular weight greater than 300 are included provided the acid has a molecular weight below about 300. The dicarboxylic acids can contain any substituent groups or combinations which do not substantially interfere with the copolyester polymer formation and use of the polymer of this invention.

Aliphatic dicarboxylic acids, as the term is used herein, refers to carboxylic acids having two carboxyl groups each attached to a saturated carbon atom. If the carbon atom to which the carboxyl group is attached is saturated and is in a ring, the acid is cycloaliphatic. Aliphatic or cycloaliphatic acids having conjugated unsaturation often cannot be used because of homopolymerization. However, some unsaturated acids, such as maleic acid, can be used.

Aromatic dicarboxylic acids, as the term is used herein, are dicarboxylic acids having two carboxyl groups attached to a carbon atom in an isolated or fused benzene ring. It is not necessary that both functional carboxyl groups be attached to the same aromatic ring and where more than one ring is present, they can be joined by aliphatic or aromatic divalent radicals or divalent radicals such as —O— or —$SO_2$—.

Representative aliphatic and cycloaliphatic acids which can be used for this invention are sebacic acid, 1,3-cyclohexane dicarboxylic acid, 1,4-cyclohexane dicarboxylic acid, adipic acid, glutaric acid, succinic acid, carbonic acid, oxalic acid, azelaic acid, diethylmalonic acid, allylmalonic acid, 4-cyclohexane-1,2-dicarboxylic acid, 2-ethylsuberic acid, 2,2,3,3-tetramethylsuccinic acid, cyclopentanedicarboxylic acid, decahydro-1,5-naphthalene dicarboxylic acid, 4,4'-bicyclohexyl dicarboxylic acid, decahydro-2,6-naphthalene dicarboxylic acid, 4,4'-methylene bis-(cyclohexane carboxylic acid), 3,4-furan dicarboxylic acid, and 1,1-cyclobutane dicarboxylic acid. Preferred aliphatic acids are cyclohexane-dicarboxylic acids and adipic acid.

Representative aromatic dicarboxylic acids which can be used include terephthalic, phthalic and isophthalic acids, bi-benzoic acid, substituted dicarboxy compounds with two benzene nuclei such as bis(p-carboxyphenyl) methane, p-oxy(p-carboxyphenyl) benzoic acid, ethylene-bis(p-oxybenzoic acid), 1,5-naphthalene dicarboxylic acid, 2,6-naphthalene dicarboxylic acid, 2,7-naphthalene dicarboxylic acid, phenanthrene dicarboxylic acid, anthracene dicarboxylic acid, 4,4'-sulfonyl dibenzoic acid, and $C_1$–$C_{12}$ alkyl and ring substitution derivatives thereof, such as halo, alkoxy, and aryl derivatives. Hydroxyl acids such as p-($\beta$-hydroxyethoxy) benzoic acid can also be used providing an aromatic dicarboxylic acid is also present.

Aromatic dicarboxylic acids are an especially preferred class for preparing the copolyetherester polymers used in this invention. Among the aromatic acids, those with 8–16 carbon atoms are preferred, particularly the phenylene dicarboxyic acids, i.e., phthalic, terephthalic and isophthalic acids and their dimethyl derivatives.

It is preferred that at least about 70% of the short segments are identical and that the identical segments form a homopolymer in the fiber-forming molecular weight range (molecular weight 5000) having a melting point of at least 150° C. and preferably greater than 200° C. Polymers meeting these requirements exhibit a useful level of properties such as tensile strength and tear strength. Polymer melting points are conveniently determined by differential scanning calorimetry.

Other orientable thermoplastic elastomers useful in the furniture support material of the present invention include polyesterurethane elastomers, such as disclosed by Schollenberger (U.S. Pat. No. 2,871,218) and polyetherester amide elastomers, such as disclosed by Foy (U.S. Pat. No. 4,331,786) and Burzin (U.S. Pat. No. 4,207,410).

Thermoplastic polyesterurethane elastomers which can be used in the instant invention are prepared by reacting a polyester with a diphenyl diisocyanate in the presence of a free glycol. The ratio of free glycol to diphenyl diisocyanate is very critical and the recipe employed must be balanced so that there is essentially no free unreacted diisocyanate or glycol remaining after the reaction to form the elastomer. The amount of glycol employed will depend upon the molecular weight of the polyester as discussed below.

The preferred polyester is an essentially linear hydroxyl terminated polyester having a molecular weight between 600 and 1200 and an acid number less than 10, preferably the polyester has a molecular weight of from about 700 to 1100 and an acid number less than 5. More preferably the polyester has a molecular weight of 800 to 1050 and an acid number less than about 3 in order to obtain a product of optimum physical properties. The polyester is prepared by an esterification reaction of an aliphatic dibasic acid or an anhydride thereof with a glycol. Molar ratios of more than 1 mol of glycol to acid are preferred so as to obtain linear chains containing a preponderance of terminal hydroxyl groups.

The basic polyesters include polyesters prepared from the esterification of such dicarboxylic acids as adipic, succinic, pimelic, suberic, azelaic, sebacic or their anhydrides. Preferred acids are those dicarboxylic acids of the formula HOOC—R—COOH, where R is an alkylene radical containing 2 to 8 carbon atoms. More preferred are those represented by the formula $HOOC(CH_2)_xCOOH$, where x is a number from 2 to 8. Adipic acid is preferred.

The glycols utilized in the preparation of the polyester by reaction with the aliphatic dicarboxylic acid are preferably straight chain glycols containing between 4 and 10 carbon atoms such as butanediol-1,4, hexamethylene-diol-1,6, and octamethylenediol-1,8. In general the glycol is preferably of the formula $HO(CH_2)_xOH$, wherein x is 4 to 8 and the preferred glycol is butanediol-1,4.

A free glycol must also be present in the polyester prior to reaction with the diphenyl diisocyanate. The units formed by reaction of the free glycol with the diisocyanate will constitute the short-chain urethane units. Similarly, the units formed by reaction of polyester with diisocyanate constitute the long-chain urethane units. Advantage may be taken of residual free glycol in the polyester if the amount is determined by careful analysis. The ratio of free glycol and diphenyl diisocyanate must be balanced so that the end reaction product is substantially free of excess isocyanate or hydroxyl groups. The glycol preferred for this purpose is butanediol-1,4. Other glycols which may be employed include the glycols listed above.

The specific diisocyanates employed to react with the mixture of polyester and free glycol are also important. A diphenyl diisocyanate such as diphenyl methane diisocyanate, p,p'-diphenyldiisocyanate, dichlorodiphenyl methane diisocyanate, dimethyl diphenyl methane diisocyanate, bibenzyl diisocyanate, diphenyl ether diisocyanate are preferred. Most preferred are the diphenyl methane diisocyanats and best results are obtained from diphenyl methane-p,p'-diisocyanate.

Thermoplastic polyetherester amide elastomers which can be used in the instant invention are represented by the following formula $$\left[\begin{array}{c} C-A-C-O-B-O \\ \| \qquad\quad \| \\ O \qquad\quad O \end{array}\right]_n$$

wherein A is a linear saturated aliphatic polyamide sequence formed from a lactam or amino acid having a hydrocarbon chain containing 4 to 14 carbon atoms or from an aliphatic $C_6$–$C_{12}$ dicarboxylic acid and a $C_6$–$C_9$ diamine, in the presence of a chain-limiting aliphatic carboxylic diacid having 4 to 20 carbon atoms; and B is a polyoxyalkylene sequence formed from linear or branched aliphatic polyoxyalkylene glycols, mixtures thereof or copolyethers derived therefrom, said polyoxyalkylene glycols having a molecular weight of between 200–6,000. The polyamide sequence A consists of a plurality of short chain amide units. The polyoxyalkylene sequence B represents a long chain unit. The polyetherester amide block copolymer is prepared by reacting a dicarboxylic polyamide, the COOH groups of which are located at the chain ends, with a polyoxyalkylene glycol hydroxylated at the chain ends, in the presence of a catalyst constituted by a tetraalkylorthotitanate having the general formula $Ti(OR)_4$, wherein R is a linear branched aliphatic hydrocarbon radical having 1 to 24 carbon atoms.

Approximately equimolar amounts of the dicarboxylic polyamide and the polyoxyalkylene glycol are used, since it is preferred that an equimolar ratio should exist between the carboxylic groups and the hydroxyl groups, so that the polycondensation reaction takes place under optimum conditions for achieving a substantially complete reaction and obtaining the desired product.

The polyamides having dicarboxylic chain ends are preferably linear aliphatic polyamides which are obtained by conventional methods currently used for preparing such polyamides, such methods comprising, e.g. the polycondensation of a lactam or the polycondensation of an amino-acid or of a diacid and a diamine, these polycondensation reactions being carried out in the presence of an excess amount of an organic diacid the carboxylic groups of which are preferably located at the ends of the hydrocarbon chain; these carboxylic diacids are fixed during the polycondensation reaction so as to form constituents of the macromolecular polyamide chain, and they are attached more particularly to the ends of this chain, which allows an $\alpha$-$\omega$-dicarboxylic polyamide to be obtained. Furthermore, this diacid acts as a chain limitator. For this reason, an excess amount of $\alpha$-$\omega$-dicarboxylic diacid is used with respect to the amount necessary for obtaining the dicarboxylic polyamide, and by conveniently selecting the magnitude of this excess amount the length of the macromolecular chain and consequently the average molecular weight of the polyamides may be controlled.

The polyamide can be obtained starting from lactams or amino-acids, the hydrocarbon chain of which comprises from 4 to 14 carbon atoms, such as caprolactam, oenantholactam, dodecalactam, undecanolactam, dodecanolactam, 11-amino-undecanoic acid, or 12-aminododecanoic acid.

The polyamide may also be a product of the condensation of a dicarboxylic acid and diamine, the dicarboxylic acid containing 4 to 14 preferably from about 6 to about 12 carbon atoms in its alkylene chain and a diamine containing 4 to 14 preferably from about 6 to about 9 carbon atoms in its alkylene chain. Examples of such polyamides include nylon 6-6, 6-9, 6-10, 6-12 and 9-6, which are products of the condensation of hexamethylene diamine with adipic acid, azelaic acid, sebacic acid, 1,12-dodecanedioic acid, and of nonamethylene diamine with adipic acid. Preferred are polyamides based on nylon-11 or 12.

The diacids which are used as chain limiters of the polyamide synthesis and which provide for the carboxyl chain ends of the resulting dicarboxylic polyamide preferably are aliphatic carboxylic diacids having 4 to 20 carbon atoms, such as succinic acid, adipic acid, suberic acid, azelaic acid, sebacic acid, undecanedioic acid and dodecanedioic acid.

They are used in excess amounts in the proportion required for obtaining a polyamide having the desired average molecular weight within the range of between 300 and 15000 in accordance with conventional calculations such as currently used in the field of polycondensation reactions.

The polyoxyalkylene glycols having hydroxyl chain ends are linear or branched polyoxyalkylene glycols having an average molecular weight of no more than 6000 and containing 2 to about 4 carbon atoms per oxylalkylene unit such as polyoxyethylene glycol, polyoxypropylene glycol, polyoxytetramethylene glycol or mixtures thereof, or a copolyether derived from a mixture of alkylene glycols containing 2 to about 4 carbon atoms or cyclic derivatives thereof, such as ethylene oxide, propylene oxide or tetrahydrofuran. Polyoxytetramethylene glycol is preferred.

The average molecular weight of the polyamide sequence in the block copolymer may vary from about 300 to about 15,000, preferably from about 1000 to about 10,000.

The average molecular weight of the polyoxyalkylene glycols forming the polyoxyalkylene sequence suitably is in the range of from about 200 to about 6,000, preferably about 400 to about 3000.

Other thermoplastic polyetherester amides which can be used in the instant invention consist of mixtures of one or more polyamide forming compounds, polytetramethyleneether glycol (PTMEG) and at least one organic dicarboxylic acid, the latter two components being present in equivalent amounts.

The polyamide-forming components are omega-aminocarboxylic acids and/or lactams of at least 10 carbon atoms, especially lauryllactam and/or omega-aminododecanoic acid or omega-aminoundecanoic acid.

The diol is PTMEG having an average molecular weight of between about 400 and 3,000.

Suitable dicarboxylic acids are aliphatic dicarboxylic acids of the general formula HOOC-$(CH_2)_x$-COOH, wherein x can have a value of between and 4 and 11. Examples of the general formula are adipic acid, pimelic acid, suberic acid, azelaic acid, sebacic acid and decanedicarboxylic acid. Furthermore usable are cycloaliphatic and/or aromatic dicarboxylic acids of at least eight carbon atoms, e.g. hexahydroterephthalic acid, terephthalic acid, isophthalic acid, phthalic acid, or naphthalene-dicarboxylic acids.

In the preparation of the polyetherester amides, conventional catalysts are utilized, if desired, in the usual quantities, such as, for example, phosphoric acid, zinc acetate, calcium acetate, triethylamine, or tetraalkyl titanates. Advantageously, phosphoric acid is used as the catalyst in amounts of between 0.05 and 0.5% by weight.

The polyetherester amides can also contain additives which are introduced prior to, during, or after the polycondensation. Examples of such additives are conventional pigments, flattening agents, auxiliary processing agents, fillers, as well as customary thermal and UV stabilizers.

The short-chain ester, urethane and amide units described above will constitute about 50–95% by weight, preferably 60–85% by weight, of the polymer and ergo, the long chain ester of ether units constitute about 5–50% by weight, preferably 15–40% by weight of the polymer. Accordingly, the shore D hardness of the polymer should be 45–85, preferably 55–75 to obtain polymers suited for the production of oriented monofilaments whose $M_{20}$ is in the range of from about 5,000 to about 45,000 p.s.i. (34.5–310.3 MPa), preferably in the range of from about 15,000 to about 25,000 p.s.i. (103.4–172.4 MPa).

If the thermoplastic elastomer filaments are sheath-/core, it is preferred that the short-chain ester, urethane or amide units be at least 50 weight percent of the core elastomer, with a minimum of 60 weight percent short-chain ester, urethane or amide units being more preferred and a range of 65 to 85 weight percent short-chain ester, urethane or amide units being most preferred for the core. The sheath thermoplastic elastomer should have a melting point of at least 20 degrees C. lower than the core elastomer, and accordingly, it will contain either a lower proportion of short-chain ester, urethane or amide units or a mixture of chemically dissimilar short-chain ester, urethane or amide units. In any event, the sheath elastomer will contain at least 15 weight percent short-chain ester, urethane or amide units, preferably at least 30 weight percent short-chain units.

The other material of construction of the furniture support material of the present invention is a non-elastomeric natural or synthetic yarn having a tensile strength of 1.5 9 grams/denier, preferably 2.5 7.0 grams/denier, including cotton, polyester, nylon, rayon, acrylic, modacrylic, and olefin yarn, (see, e.g. Matthews' Textile Fibers and Man-Made Fibers both published by John Wiley). Polyester yarn, such as described in Man Made Fibers, R. W. Moncrieff Chapter 26, pages 434–481 (1975) is preferred. While any of the many commercially available polyester yarns can be used in the furniture support material of the present invention, 2GT polyester (polyethylene terephthalate) staple yarn is most preferred. Physical properties of the yarn are optimized by orientation similar to that used with thermoplastic elastomer filaments, i.e., finished product orientation of the polyester yarn will be similar to the finished product orientation of the elastomer at 3 to 4X, although some polyester yarns being a finished product orientation of up to 6.0X have been found suitable, however, machine orientation of the polyester yarn will differ from that used in the elastomer because of the non-elastomeric nature of the polyester yarn. Similar orientation of the other synthetic yarns will also give product with optimum properties.

Monofilaments of copolyetherester, polyesterurethane and polyetheresteramide elastomer, either solid or sheath/core and yarn can be formed into a net pattern, either by merely laying such filaments across one another or by interweaving the filaments with one another, and subsequently affixing the filaments and yarn to one another at the intersections. Affixing of the filaments and yarn at the intersections can be by use of conventional adhesives or textile binders. Commercial suspensions of resin in water can be coated onto the fabric, dried to remove water, and cured at 110° to 150° C. for 30 to 200 seconds. The curing crosslinks the resin in the binder and adheres the warp yarn and fill filament together. Preferably, bonding of the filaments and yarn at the intersections is effected by heating the filaments to their melting point applying sufficient pressure for the respective filaments to flow together, and cooling. In this embodiment, it is preferred that the elastomer be oriented to a final stretch ratio of 3X to 4X before it is placed in the net configuration. Further it is preferred that the monofilament be of the sheath/core variety where the core is the higher melting component. When bonding is effected by heating to the melting point of the elastomer, orientation is at least partially destroyed; however when the filament is of the sheath/core variety, bonding is effected by heating only up to the melting point of the sheath (the core is always higher melting), then only the orientation of the sheath layer is significantly disturbed. The orientation of the core remains substantially undisturbed, and the increased physical properties achieved by orientation of the core filament remain largely undisturbed.

During heat sealing, the furniture support material of the present invention is heated in air at 140° to 180° C. in a tenter oven for 20 to 60 seconds. This causes the sheath of the coextruded monofilament to soften and adhere to the warp yarn. Upon cooling, the fabric is stable and can be cut, sewn and adhesively sealed or stapled to form a suspension.

Alternatively, the elastomer filaments and the yarn can be affixed to each other at the intersections by selecting the weaving pattern to be of such a configuration that the yarn will lock in place about the filament; for example a standard leno weave or gauze weave pattern where the yarn is in the warp direction will have this effect, thus obviating the need for adhesive or melting of the elastomer.

The desirable properties characteristic of the furniture support material of the present invention can be achieved with some variety in the spacing of the elastomer filaments and the yarn and with some variety in the relative proportions of the elastomer monofilament and the yarn. Generally the elastomer filaments should be spaced such that the number of picks per meter is in the range of $$\frac{16}{(a)} \text{ to } \frac{160}{(a)}$$

where (a) is the cross-sectional area of the filament in $mm^2$. The yarn should be spaced such that the number of strands per meter is in the range of $$\frac{1 \times 10^5}{\text{yarn denier}} \text{ to } \frac{2.5 \times 10^6}{\text{yarn denier}}$$

It should be noted that the desirable properties characteristic of the furniture support material of the present invention may not be achieved if one chooses from within the above-recited ranges a combination of low elastmer filament content and high yarn content. Accordingly one should generally avoid such a combination. More specifically, if one were to plot filament content $$\left(\text{from } \frac{16}{(a)} \text{ to } \frac{160}{(a)}\right)$$

on the abscissa and yarn content $$\left(\text{from } \frac{1 \times 10^5}{\text{yarn denier}} \text{ to } \frac{2.5 \times 10^6}{\text{yarn denier}}\right)$$

on the ordinate, one should avoid combinations of filament content and yarn content within the triangle formed by the following three points:

| Point | Filament content | Yarn content |
|---|---|---|
| 1 | 16/a | $7.8 \times 10^5$/yarn denier |
| 2 | 28/a | $2.5 \times 10^6$/yarn denier |
| 3 | 16/a | $2.5 \times 10^6$/yarn denier |

It should be understood that variations from the configurations described above can be made without deviating from the concepts and principles embodied in the present invention. For example, while it is preferred that the furniture support material of the present invention have a uniform density of fill and of warp, variable density warp and/or fill can be achieved by varying the picks (or strands) per inch or by varying the diameter (or denier) of the monofilaments (or yarn). Similarly, while it is preferred to have only elastomer in one direction and only yarn in the perpendicular direction, it is possible to intersperse a minor quantity of non-elastomeric yarn or monofilament in the elastomer and/or a minor quantity of elastomer in the yarn.

The net furniture support material of the present invention has a unique combination of properties not found in commercially available furniture support materials and not found in experimental furniture support materials having the same or similar geometric configuration as the net furniture support material of the present invention but made from materials other than oriented thermoplastic elastomer in the fill direction and polyester yarn in the warp direction. In particular, the net furniture support material of the present invention has a combination of high tear resistance, high flexibility and low creep (both dead load static creep and dynamic creep). In addition the support factor and the K-factors, as hereinafter defined, of the net furniture support material of the present invention are quite low, thus permitting very light weight furniture support members. The furniture support material of the present invention can be sewn and/or glued to provide the required suspension shapes and sizes as well as support hardware pockets and reinforcements.

Tear resistance is a measure of the energy required to tear a predetermined length of the netting (or other furniture support material), normalized per unit weight or areal density (weight per unit area). The quantification of this property is achieved by preparing a rectangular sample of the seating support material 30.6 cm by 10.2 cm. This sample is then slit halfway down the center of the 30.6 cm length. The two sides are mounted in an Instron tensile tester to pull a standard trouser tear similar to ASTM D-470, section 4.6. The sample is pulled to destruction at a rate of 5.1 cm/min. The resultant curve of force versus deflection is integrated to obtain a value for the total energy required to complete the 15.3 cm tear and the energy is divided by the areal density (weight per unit area) of the material to normalize the result. A minimum value of 0.40 joules/meter-gram/meter$^2$ is considered satisfactory.

Creep, both dead load static creep and dynamic creep, are measures of the ability of the furniture support material to retain its original shape and resilience after being subjected to loading. This property of the furniture support material is generally considered along with the unit weight of the support material. For economy of use and, in particular, for weight reduction considerations in automotive and aircraft applications, it is the objective to keep both creep and unit weight at minimum levels. Generally, creep properties vary directly with the magnitude of the applied forces and inversely with the unit weights of furniture support material. Thus one frequently must choose between very low creep and very low unit weight, or select a material somewhere in the middle, which has neither very low creep nor very low unit weight. The materials of the present invention do offer both low creep and low unit weight. This is best understood by referring to the relationship between creep on the one hand, and force and unit weight, on the other. This relationship can be represented by the following equation:

Creep = C × Force/Unit weight where "C" is a constant for any particular material.

In all of the creep tests conducted on the furniture support materials of this invention, the force was the same so that the numerator of the equation, C × Force, can be represented by K which will hereafter be referred to as the "K-factor". As seen from the above equation, this K-factor is equal to the creep times the unit weight and, again, it is the industry objective to achieve minimum values for the "K-factor" values of the various furniture support materials used in the industry. This objective is achieved with the materials of the present invention.

Dead load static creep is a measure of the ability of the furniture support material to retain its original shape and resiliance after being subjected to a static load for an extended period. The quantification of this property is achieved by preparing a seat bottom having a 0.33 meter by 0.38 meter opening, said seat bottom being made of 2.5 cm thick grade AB exterior plywood. Samples A, F, G and J of the support materials to be tested were stretched approximately 8% in both directions and stapled in place on all four sides. Samples B-E were stretched approximately 6% in the fill direction and 3% in the warp direction. Samples H and I were stretched approximately 17% in both directions. These different amounts of pre-stretching were necessary to provide equivalent values for initial deflection. A 334 Newton weight is placed on a 20.3 cm diameter wooden disc which is in turn placed on the furniture support material and left for 112 days. The deflection of the seat bottom is measured at the beginning and the end of the 112 days, and the percent change in deflection is calculated according to the following formula:

$$\%\ \text{change in deflection} = \frac{D_{112} - D_0}{D_0} \times 100$$

where $D_0$ is the deflection at the beginning of the 112 days, and $D_{112}$ is the deflection at the end of the 112 days. A maximum value of 14.0% is considered preferred. When extremely light weight materials are desired, some sacrifice in dead load static creep can frequently be tolerated and values as high as 20.0% are considered satisfactory.

While some commercially available competitive materials may offer dead load static creep values approaching this upper limit, they do so only in materials having a considerably higher unit weight. This distinction is most easily demonstrated using the dead load static creep "K-factor", which as described above, equals the actual static creep times the unit weight. Thus if two materials offer the same creep, but one weighs four times as much, the K-factor of the less desirable fabric will be four times higher. Similarly, if they had the same unit weight, but one had four times less creep, the K-factor of the more desirable fabric would be four times lower. For the purpose of further defining the present invention, a static creep K-factor of less than 6000 is considered satisfactory with less than 3000 especially preferred.

Dynamic creep is a measure of the ability of the furniture support material to retain its original shape and resiliance after being subjected to repeated flexing under load. The quantification of this property is achieved by preparing a seat bottom with a 0.33 meter by 0.38 meter opening, said seat bottom being made out of 2.5 cm thick grade AB exterior plywood. Samples A, F, G and J of the support material to be tested were stretched approximately 8% in both directions and stapled in place on all four sides. Samples B-E were stretched approximately 6% in the fill direction and 3% in the warp direction. Samples H and I were stretched approximately 17% in both directions. These different amounts of pre-stretching were necessary to provide equivalent values for initial deflection. Next a burlap fabric was loosely stapled over the support material, followed by a 2.5 cm thick layer of open cell 0.047 g/cm$^3$ density polyurethane foam, which is in turn covered by a 0.045 g/cm$^2$ upholstery fabric. During the test a 778 Newton weight was placed on a buttock form to simulate a 778 Newton man, which was in turn, placed on the completed seat bottom. This weighted buttock form was then raised (so that there was no weight on the seat bottom) and lowered (so that the seat bottom was supporting the full weight) repeatedly for 25,000 cycles at a frequency of 1050 cycles/hour.

The dynamic creep (i.e. % change in deflection) is calculated according to the following formula:

$$\%\text{ change in deflection} = \frac{D_{25,000} - D_0}{D_0} \times 100$$

where $D_0$ is the deflection of the uncovered (i.e. no burlap, polyurethane form or upholstery fabric) seat bottom due to a 334 Newton weight using a 20.3 cm diameter wooden disc before the test was started, and $D_{25,000}$ is the deflection of the uncovered seat bottom due to a 334 Newton weight using a 20.3 cm diameter wooden disc after 25,000 cycles. A maximum value of 8.0 is considered preferred. As with static creep, where extremely light weight materials are desired, some sacrifice in dynamic creep can frequently be tolerated and values as high as 22.0% are considered satisfactory.

While some commercially available competitive materials may offer dynamic creep values which approach or better this upper limit, they do so only in materials having a considerably higher unit weight. This distribution is most easily demonstrated using the dynamic creep "K-factor", which as described above, equals the actual dynamic creep times the unit weight. For the purpose of further defining the present invention, a dynamic creep K-factor of less than 5000 is considered satisfactory, with less than 2500 especially preferred.

Flexibility, or deflection, is a measure of the ability of the furniture support material to provide a moderate amount of flex under a moderate load. Too much flex and the seat will be considered to be soft or saggy. Too little flex and the seat will be considered too stiff, hard and uncomfortable. The quantification of this property is achieved by preparing a seat bottom having a 0.33 meter by 0.38 meter opening, said seat bottom being made of 2.5 cm thick grade AB exterior plywood. Samples A, F, G and J of the support materials to be tested were stretched approximately 8% in both directions and stapled in place on all four sides. Samples B–E were stretched approximately 6% in the fill direction and 3% in the warp direction. Samples H and I were stretched approximately 17% in both directions. These different amounts of pre-stretching were necessary to provide equivalent values for initial deflection. A 334 Newton weight is placed on a 20.3 cm diameter wooden disc which is, in turn, placed on the furniture support material, the weight and the disc being approximately centrally located on the furniture support material. The deflection of the furniture support material is measured in centimeters. A value of 1.25–7.50 cm is considered satisfactory.

Support factor is a measure of the amount (or mass) of furniture support material necessary to provide a predetermined amount of support. This can be considered a measure of the efficiency of the furniture support material. The more efficient the furniture support material, the lighter the furniture support material needed to do a particular job. The quantification of this property is achieved by preparing a seat bottom with a 0.33 meter by 0.38 meter opening, said seat bottom being made out of 2.5 cm thick grade AB exterior plywood. Samples A, F, G and J of the support material to be tested was stretched approximately 8% in both directions and stapled on all four sides, and the force which will give a deflection of 3.8 cm (using the 20.3 cm diameter wooden disc as above) is measured. Samples B-E were stretched approximately 6% in the fill direction and 3% in the warp direction. Samples H and I were stretched approximately 17% in both directions. These different amounts of pre-stretching were necessary to provide equivalent values for initial deflection. The weight of the furniture support material necessary to cover the seat bottom (including the material under the staples) is measured and the support factor is calculated according to the following formula:

$$\text{Support Factor} = \frac{445 \times Se}{Fe}$$

where

Se is the actual mass in grams of furniture support material, and

Fe is the actual weight (in Newtons) observed at a deflection of 3.8 cm of the furniture support material.

A maximum value of 55 grams is considered satisfactory.

In contrast to prior seat suspension products, the furniture support material of the present invention is light in weight and has little bulk. It also has the unique feature of having the elastomeric strands in one direction only. The yarn strands in the warp with their higher modulus, provide both strength and resilience to the suspension. They also provide many flexible locking points to prevent failure of the fabric due to separation of the warp and fill strands.

In automotive seating, where only two opposite edges of the fabric are secured to the seat frame, the fabric is placed so that the elastomer filaments run in the direction between the support clips on the seat frame. As the furniture support material is placed under load, the elastomer elongates and the yarn holds the fabric together. However, in household furniture applications, the fabric performs equally well when it is stretched over a wooden seat frame and stapled to the underside of the frame along all four edges. In this case, the elastomer filaments elongate in one direction and the yarn elongates little, but stretch is provided by the relatively loose plain or leno weave. Extension of both elements of the fabric provides comfortable support in the seat, but the elastomeric elements provide the resilience.

Automotive seat suspensions can be constructed from the fabric by cutting to desired shape with the elastomer filaments running in the principal direction of desired elongation. This normally would be the direction defined by a line connecting suspension support clips in the seat frame. Material allowance is provided so that pockets can be formed on two opposite sides of the suspension to accept steel rods. The rods provide the edge support for fastening the suspension to the seat frame clips. Pockets can be secured by sewing or adhesive sealing. A seat suspension can also be made by overlapping opposite ends of the fabric piece and sewing or adhesive sealing. Again, metal rods inserted in the loop of the fabric can be used to provide support for attachment to the seat frame. Seat backs can be fabricated in a similar fashion.

Furniture seat suspensions for a wooden frame chair can be constructed by stretching the fabric over a chair seat frame and stapling it in place to the underside of the frame. Suspensions for seats and backs for chairs and other furniture pieces can be similarly constructed.

The fabric described has physical properties which uniquely suit it for automotive and aircraft seat suspensions, furniture seat and back suspensions and bedding suspensions, particularly for portable and fold-away beds. It has low static and dynamic creep, good tear strength, deflection under load (that can be tailored to a wide range of comfort requirements), and excellent ozone resistance. In addition, the furniture support material of the present invention is very light weight.

In the following examples, there are shown specific embodiments of the present invention in direct sidbe-by-side comparison with embodiments of commercially available support materials and embodiments similar in physical configuration to the embodiments of the present invention but made from materials of construction other than thermoplastic elastomers and yarn. It will be seen that only the embodiments of the present invention have the requisite combination of properties—high tear resistance, good flexibility and low creep (both static and dynamic). In addition, it will be seen that the embodiments of the present invention have a low support factor and K-factors (high efficiency), particularly as compared to several of the commercially available support materials.

All parts and percentages are by weight and all temperatures are in degrees Celsius, unless otherwise specified. Measurements not originally in SI units have been so converted and rounded where appropriate.

EXAMPLE 1

Preparation of Woven Netting with Polyester Yarn Warp and Copolyetherester Elastomer Monofilament Fill A plane weave fabric was prepared with a 2GT polyester staple yarn (30/2 ply cotton count polyester) warp having 3300 ends per 75 inches (1.9 meters) of loom width having an approximate denier of 390. The fill was 20 mil (0.51 mm) diameter coextruded monofilament prepared substantially as described in U.S. Pat. Nos. 3,992,499 and 4,161,500. The sheath comprises 30% by weight of the monofilament and is comprised of a copolyetherester elastomer as described in Example 1 in U.S. Pat. No. 3,651,014. This copolyester contains 37.6% butylene terephthalate units, 10.9% butylene isophthalate units and 51.5% long chain units derived from PTMEG-1000 (i.e. polytetramethylene ether glycol having an average molecular weight of 1000) and terephthalic and isophthalic acids. The core comprises 70% by weight of the monofilament and is comprised of a copolyetherester elastomer prepared substantially as in Example 1-B of U.S. Pat. No. 3,763,109, except that the amount of dimethyl terephthalate was increased from 40.5 parts to 55.4 parts. The resulting copolyester contained 81.6% butylene terephthalate short chain ester units and 18.4% long chain ester units derived from PTMEG-975 (i.e. polytetramethylene ether glycol having an average molecular weight of 975) and terephthalic acid.

The coextruded sheath/core monofilament was oriented to a machine orientation of 4.2X (product orientation of about 3.2X). Eight picks per inch (about 3 picks per cm.) of fill were used. Finished fabric width was 72 inches (1.8 meters). After weaving, the fabric was heat bonded (to affix the intersections of the polyester warp and the copolyetherester elastomer fill) in a tenter frame at 170° C. with a residence time of 45 seconds.

The heat bonded fabric was cut and applied to frames as described above with the copolyetherester elastomer fill running in the longer direction. This fabric will be identified hereinafter as Sample A.

Additional woven fabric samples were prepared in a manner similar to that used for Sample A, above, except as described below. The polyester staple yarn used in Samples B, D and E was a 30/2 ply cotton count polyester yarn having an approximate denier of 350. Sample C was made on a fly-shuttle loom using a leno weave. The warp was a 350 denier, 100 filament, 2 GT weaving yarn, having a nominal tenacity of 7.3 gm/dn and an elongation at break of 14.4%.

The heat bonding (to affix the intersections of the polyester warp and the copolyetherester elastomer fill) of all of Samples B–E was done in a tenter frame at 170° C. with a residence time of 30 seconds.

The copolyetherester elastomer sheath/core monofilament was such that the sheath comprised 20% by weight and the core comprised 80% by weight of the monofilament. The diameter of the copolyetherester elastomer sheath/core monofilament was 14 mil.

Further characterization of the fabric is shown in the following table:

TABLE I

| | FABRIC SAMPLE DESCRIPTION | | |
|---|---|---|---|
| Sample | Monofilament Fill Picks Per Inch | Yarn Warp Strands Per Inch | Weave |
| B | 27 | 44 | Plain |
| C | 12 | 40 | Leno |
| D | 12 | 44 | Plain |
| E | 6 | 44 | Plain |

In the following Tables samples F through J represent commercially available materials defined as follows:

Sample F was a "Vexar" plastic netting, available from Amoco Fabrics, Co., Atlanta, Ga. having the following specifications:

Composition—"ProFax" Polypropylene Type 6523
Strand count—0.6 strand per centimeter
Strand cross-section—0.07 cm by 0.03 cm
Orientation ratio—2.9X Sample G was a "Vexar" plastic netting available from Amoco Fabrics, Co., of Atlanta, Ga. having the following specifications:

Composition—"Alathon" high density polyethylene resin type 5294
Strand count—0.6 strands per centimeter
Strand cross-section—0.04 cm by 0.08 cm
Orientation ratio—2.9X Sample H was a woven natural rubber netting type 1480 ORTHA-WEB manufactured by Mateba Webbing of Canada, Dunnsville, Ontario, Canada. The construction of this product consisted of double wrapped natural rubber strands in the warp direction and textured yarn in the fill direction. Dimensions of the warp and fill components were estimated to be:

Strand count warp—6 strands per centimeter
Strand count fill—3 strands per centimeter
Strand cross-section-warp—0.02 cm diameter
Strand cross-section-fill—0.02 cm×0.01 cm Sample I was J. P. Stevens "Flexor" Type K-1692-S available from United Elastic Division, J. P. Stevens and Company, Inc., Woolwine, Va. This product was a knit fabric made on a Raschel machine with a stable stitch and had the following properties:

Composition—warp 19% Spandex, fill 81% nylon
Strand count—warp 6 strands per cm, fill 18 strands per centimeter
Strand diameter warp 0.03 cm, fill 0.006 cm Sample J was a J. P. Stevens "Flexor" Type K-1949-S which was similar to Sample H above, but had the following physical properties:

Composition warp—30% Spandex, fill 70% nylon
Strand count—warp 6 strands per cm, fill 16 strands per cm.
Strand diameter—warp 0.04 cm, fill 0.006 cm

TABLE II

COMPARISON OF VARIOUS MATERIALS FOR USE AS FURNITURE SUPPORT

| Sample | Tear Resistance J/m-g/m$^2$ | Dead Load Static Creep % Change | Static Creep K-Factor % Change - g/m$^2$ | Dynamic Creep % Change | Dynamic Creep K-Factor % Change - g/m$^2$ |
|---|---|---|---|---|---|
| A | 0.49 | 13.6 | 3290 | 1.0 | 242 |
| B | 0.97 | 4.4 | 1090 | 1.0 | 242 |
| C | 0.44 | 10.5 | 1500 | 5.0 | 715 |
| D | 0.51 | 13.3 | 1980 | 14.8 | 2200 |
| E | 0.98 | 19.6 | 2200 | 20.6 | 2300 |
| F | 0.24 | 39.7 | 3900 | * | * |
| G | 0.34 | 24.2 | 2090 | * | * |
| H | 0.19 | 30.9 | 34,900 | 10.2 | 11,530 |
| I | 1.00 | 36.4 | 64,600 | 3.7 | 6570 |
| J | 1.00 | 21.9 | 9960 | 23.9 | 10,870 |
| Satisfactory range | ≧0.40 | <20.0 | <6000 | <22.0 | <5000 |

*Sample tore during test

TABLE III

ADDITIONAL PROPERTIES OF VARIOUS FURNITURE SUPPORT MATERIALS

| Sample | Support Factor (g) | Deflection (cm) |
|---|---|---|
| A | 21.7 | 2.95 |
| B | 26.0 | 1.83 |
| C | 16.0 | 1.93 |
| D | 18.7 | 2.18 |
| E | 18.4 | 2.84 |
| F | 41.2 | 5.80 |
| G | 26.0 | 4.50 |
| H | 308 | 4.85 |
| I | 313 | 2.65 |
| J | 55.6 | 2.45 |
| Satisfactory range | <55 | 1.25–7.50 |

EXAMPLE 2

Preparation of Woven Netting with Polyester Yarn Warp and Various Sheath/Core Elastomer Monofilament Fill Three fabric samples were made using a polyester yarn warp and a monofilament fill with monofilaments having sheaths of copolyetherester elastomer as described in Example 1 in U.S. Pat. No. 3,651,014. This copolyester contains 37.6% butylene terephthalate unit, 10.9% butylene isophthalate units and 51.5% long chain units derived from PTMEG-1000 and terephthalic and isophthalic acids. The core of the monofilament fill was a thermoplastic elastomer as follows:

TABLE IV

| Sample | Core Composition |
|---|---|
| K | "Huls" E62L - a polyetherester amide |
| L | "Pebax" 6312 - a polyether block amide of nylon 11 and PTMEG |
| M | "Estane" 58130 - a polyurethane with a polyester and polyether base. |

The monofilaments were coextruded and oriented to 4X. The sheath/core ratio in each of the monofilaments was 20/80 and the caliper of each of the monofilaments was 20 mils (0.51 mm). The warp yarn was 30/2-ply cotton count polyester yarn, approximately 350 denier. The samples were plain woven and heat sealed in a tenterframe with a residence time of 30 seconds and an air temperature of 166° C. The samples contained 7 picks/inch (280 picks/meter) of the monofilament fill and 46, 47 and 55 strands/inch (1800, 1900 and 2200 strands/meter) of the polyester yarn warp in each of Samples K, L and M, respectively.

EXAMPLE 3

Preparation of Woven Netting with Various Yarn Warp and Copolyetherester Elastomer Monofilament Fill A series of fabric samples were made using a 744 strand warp of oriented, coextruded sheath/core copolyetherester monofilament, the same as described above in Example 1 except that the sheath/core ratio was 20/80 and the monofilament diameter was 14 mils (0.36 mm). Four different fill yarns were woven into the warp on a projectile shuttle loom. Yarn ends were tucked into each selvage to secure the weave. Following weaving the fabrics were heat sealed on the hot rolls of a Machine Direction Stretcher. The fabric was processed without stretching between the slow and fast rolls. Cloth leaders were sewn to the fabric to permit machine threadup and prevent machine direction shrinkage during the heating operation. Three nip rolls were also used to prevent fabric slippage on the rolls.

All samples contained 42 picks/inch (1650 picks/meter) of the yarn fill, 12 strands/inch (472 strands/meter) of the monofilament warp and were sealed at 170° C. Of the yarns used the acrylic yarn heat sealed best. It was followed by the nylon and rayon yarns. The cotton yarn had the least amount of seal. However, in each case the fabric was stable after heat sealing in contrast to its "as woven" state.

Weaving conditions were selected to give yarn and monofilament contents in the fabrics that are very close to those obtained with yarn warp weaving. Heat sealing conditions were similar to those used in tenterframe heat sealing. The temperature level was the same, but the machine speed was slower, 10 ft./min. (5.1 cm/sec) vs 30 ft./min. (15.2 cm/sec). In addition, two passes through the MD machine were needed.

Samples N, O, P and Q were prepared as described above with the yarn fill as follows:

TABLE V

| Sample | Fill Type |
|---|---|
| N | Cotton, 30/2 ply cotton count |
| O | Nylon, 30/2 ply cotton count |
| P | Rayon, 20/2 ply cotton count |
| Q | Acrylic, 20/2 ply cotton count |

Each of Samples K–Q was tested as described above in Example 1 with the following results:

TABLE VI

COMPARISON OF VARIOUS MATERIALS FOR USE AS FURNITURE SUPPORT

| Sample | Tear Resistance J/m-g/m$^2$ | Dead Load Static Creep % Change | Static Creep K-Factor % Change-g/m$^2$ | Dynamic Creep % Change | Dynamic Creep K-Factor % Change-g/m$^2$ |
|---|---|---|---|---|---|
| K | 1.15 | 15.8 | 2510 | 14.0 | 2230 |
| L | 2.01 | 4.3 | 700 | 14.6 | 2380 |
| M | 1.54 | 25.7 | 4200 | 17.0 | 2270 |
| N | 0.87 | 11.9 | 2100 | 40.3 | 4720 |
| O | 2.25 | 13.2 | 2690 | 8.1 | 1650 |
| P | .78 | 21.2 | 5100 | 14.2 | 3410 |
| Q | 1.93 | 24.1 | 3760 | 11.7 | 1830 |

TABLE VII

ADDITIONAL PROPERTIES OF VARIOUS FURNITURE SUPPORT MATERIALS

| Sample | Support Factor (g) | Deflection (g) |
|---|---|---|
| K | 17.1 | 2.4 |
| L | 17.2 | 2.3 |
| M | 22.2 | 2.7 |
| N | 19.8 | 2.5 |
| O | 23.0 | 2.6 |
| P | 33.8 | 3.1 |
| Q | 28.6 | 2.4 |

EXAMPLE 4

Preparation of Bed Support Material

A bed frame was constructed from 2×10 inch (5.1×25.4 cm) framing lumber, said frame having outside dimensions of 36×72 inches (0.91–1.82 m). A furniture support material substantially as described for Sample B, above, was installed with 5% pre-strain in both directions. Initial deflection under a 180 pound (800 Newtons) load was observed at 2.25 inches (5.7 cm), similar to that observed in commercially available bedding support material. The support material of the present invention was also observed as being more comfortable, lighter, more compact and quieter than commercially available hideaway bed support systems.

INDUSTRIAL APPLICABILITY

The oriented thermoplastic elastomer/yarn woven furniture support material of the present invention is useful in the manufacture of seat backs and bottoms intended for use in automobiles, aircraft and also in conventional household and industrial furniture. The unique combination of the properties possessed by the furniture support material of the present invention, i.e., high tear resistance, good flexibility, low creep and low support factor render these materials particularly well suited for use in applications where high performance and low weight are especially desirable, such as in automotive and aircraft seating.

BEST MODE

Although the best mode of the present invention, that is the single most preferred embodiment of the present invention, will depend upon the particular desired end use and the specific requisite combination of properties needed for that use; generally, the most preferred embodiment of the present invention is that described in detail above as Sample D.

We claim:

1. A furniture support material in a woven configuration comprising crossed strands in a first direction and in a second direction perpendicular to the first direction, wherein the strands in the first direction comprise oriented thermoplastic elastomer monofilament selected from the group consisting of copolyetheresters, polyurethanes and polyesteramides, and the strands in the second direction comprise yarn, which crossing strands are affixed to each other at the points at which they cross, which furniture material has a tear resistance value of at least 0.40 joules/meter-gram/meter$^2$, has a dead load static creep K-factor value of less than 6000 percent change in deflection-grams/meter$^2$, has a deflection value of 1.25–7.50 cm, and has a dynamic creep K-factor value of less than 5000 percent change in deflection-grams/meter$^2$.

2. The furniture support material of claim 1 wherein the strands are bonded to each other.

3. The furniture support material of claim 2 wherein the strands are bonded by partial melting of the elastomer strands.

4. The furniture support material of claim 1 wherein the elastomer strands are of a sheath/core configuration wherein the sheath is a elastomer whose melting point is at least 20 degrees C. lower than the melting point of the elastomer in the core.

5. The furniture support material of claim 2 wherein the strands are bonded to each other by textile adhesive.

6. The furniture support material of claim 1 which has been made by weaving of oriented monofilaments of thermoplastic elastomer with yarn in a leno weave configuration.

7. The furniture support material of claim 1 which has been made by weaving of oriented monofilaments of thermoplastic elastomer with yarn in a plain weave configuration.

8. The furniture support material of claim 1 wherein the product orientation ratio of the elastomer strands is at least 3.0X.

9. The furniture support material of claim 1 wherein the warp fiber strands comprise polyester yarn and the fill fiber strands comprise copolyetherester elastomer monofilament.

10. The furniture support material of claim 9 wherein the copolyetherester elastomer is a sheath/core monofilament wherein the sheath copolyetherester elastomer contains at least 25 weight percent short-chain ester units and the core copolyetherester elastomer contains at least 50 weight percent short-chain ester units.

11. The furniture support material of claim 1 wherein the dead load static creep K-factor value is less than 3000 percent change in deflection-grams/meter$^2$ and the dynamic creep K-factor is less than 2500 percent change in deflection-grams/meter$^2$.

12. The furniture support material of claim 1 wherein the dead load static creep is less than 20.0 percent change in deflection and the dynamic creep is less than 22.0 percent change in deflection.

13. The furniture support material of claim 12 where the dead load static creep is less than 14.0 percent change in deflection and the dynamic creep is less than 8.0 percent change in deflection.

14. The furniture support material of claim 1 wherein the thermoplastic elastomer monofilament has an $M_{20}$ strength of 34–310 MPa.

15. The furniture support material of claim 1 wherein the thermoplastic elastomer monofilament has an $M_{20}$ strength of 103–172 MPa.

16. The furniture support material of claim 1 wherein the thermoplastic elastomer is polyesterurethane.

17. The furniture support material of claim 1 wherein the yarn has a tensile strength of 1.5–9.0 grams/denier.

18. The furniture support material of claim 1 wherein the yarn has a tensile strength of 2.5–7.0 grams/denier.

19. The furniture support material of claim 1 wherein the yarn is selected from the group consisting of polyester, cotton, nylon, rayon, acrylic, modacrylic and olefin fibers.

20. The furniture support material of claim 1 wherein the elastomer filaments are spaced such that the number of picks/meter is in the range of $$\frac{16}{(a)} \text{ to } \frac{160}{(a)}$$

where (a) is the filament cross-sectional area in mm$^2$.

21. The furniture support material of claim 1 wherein the yarn strands are spaced such that the number of strands/meter is in the range of $$\frac{1 \times 10^5}{\text{yarn denier}} \text{ to } \frac{2.5 \times 10^6}{\text{yarn denier}}.$$

22. The furniture support material of claim 1 wherein:

(a) the elastomer is a copolyetherester having an $M_{20}$ strength of 103–172 MPa, (b) the yarn is a polyester yarn having a tensile strength of 2.5–7.0 grams/denier, (c) the elastomer filament is a sheath/core monofilament wherein the sheath contains at least 25 weight percent short-chain ester units, the core contains at least 50 weight percent short-chain ester units, and the sheath elastomer has a melting point at least 20° C. lower than the melting point of the core elastomer, (d) the elastomer filaments and the yarn strands are bonded at the points at which they cross by partial melting of the sheath elastomer.

23. A seat bottom made from the furniture support material of claim 1.

24. A seat back made from he furniture support material of claim 1.

25. A bedding support system made from the furniture support material of claim 1.

26. The furniture support material of claim 1 wherein the thermoplastic elastomer is polyetheresteramide.

* * * * *